US005187522A

United States Patent [19]

Resch, III

[11] Patent Number: 5,187,522

[45] Date of Patent: Feb. 16, 1993

[54] MAGNETIC MONITOR FOR MEASURING TONER CONCENTRATION

[75] Inventor: William A. Resch, III, Pittsford, N.Y.

[73] Assignee: Eastman Kodak Company, Rochester, N.Y.

[21] Appl. No.: 802,595

[22] Filed: Dec. 5, 1991

[51] Int. Cl.[5] ..... G03G 15/00

[52] U.S. Cl. ..... 355/246; 118/688; 118/689; 355/208

[58] Field of Search ..... 118/652, 696, 689, 688, 118/690, 646, 658, 657; 355/246, 245, 209, 203, 208; 222/DIG. 1

[56] References Cited

U.S. PATENT DOCUMENTS

| | | | |
|---|---|---|---|
| 4,147,127 | 4/1979 | Terashima | 118/646 |
| 4,200,388 | 4/1980 | Hasebe et al. | 118/712 X |
| 4,270,487 | 6/1981 | Terashima et al. | 118/690 |
| 4,496,240 | 1/1985 | Yamashita et al. | 118/688 X |
| 4,650,310 | 3/1987 | Hayashida et al. . | |
| 4,775,915 | 10/1988 | Walgrove . | |
| 4,947,788 | 8/1990 | Hill et al. | 118/653 |
| 4,951,096 | 8/1990 | Derimiggia et al. | 355/285 |
| 4,963,929 | 10/1990 | Ueda et al. | 355/215 |

FOREIGN PATENT DOCUMENTS

| | | |
|---|---|---|
| 6239780 | 11/1985 | Japan . |
| 0164150 | 7/1986 | Japan . |

*Primary Examiner*—A. T. Grimley
*Assistant Examiner*—T. A. Dang
*Attorney, Agent, or Firm*—David A. Howley

[57] ABSTRACT

A monitor for sensing the concentration of toner particles in the development station of an electrostatographic machine, which has a curved sump inner wall surface, includes a solenoid having a coil-form with one end adapted to be positioned adjacent to the outer surface of the sump wall, and a shield at least partially surrounding the solenoid. The shield has an end adjacent to the wall, and the surfaces of the ends of the central coil-form and the shield define a substantially cylindrical surface which conforms to the shape of the inner wall of the sump. Preferably, the surfaces of the ends of the coil-form and the shield are adapted to be substantially equal distant for the inner wall of the sump of a received development station.

4 Claims, 2 Drawing Sheets

MAGNETIC MONITOR FOR MEASURING TONER CONCENTRATION

BACKGROUND OF THE INVENTION

1. Technical Field

This invention relates generally to developer mixture monitors for detecting the concentration of toner particles in electrostatographic machines, and more particularly to such monitors adapted to best cooperate with development stations having curved sump walls.

2. Background Art

Known magnetic toner monitors rely on a sensing element which consists of an electromagnet solenoid having a coil-form with one end adapted to be directed toward the development mixture to be monitored. FIG. 1 illustrates a typical toner monitor 10, which includes an unshielded solenoid winding 12 wound on a coil-form 14. Some monitors include a shielding cup 16 of permeable material for confining the magnetic field path to reduce the effect on the solenoid's inductance of material behind and beside the solenoid. The monitor is generally enclosed in a plastic protective covering 18. The face of the protective covering abuts the outer surface of the development station sump wall 20, or, alternatively, protrudes through a hole in the development station wall.

Such monitors produce a signal characteristic of changes to the inductance of the solenoid due to the presence of magnetic material within the fringe field of the solenoid. Since toner particles are formed of magnetic material and carrier is not, the signal produced by the monitor is proportional to the concentration of toner particles in the portion of the development mixture that is within the fringe field of the solenoid. The more of the fringe field that is filled with the development mixture, the greater will be the monitor's sensitivity.

At the open of these conventional shielded toner monitors, solenoid winding 12 and surrounding shielding cup 16 terminate in a single plane, even with one another; for they are intended to be mounted against the flat, planar outer surface of sump wall 20, as illustrated in FIG. 1; or to protrude through the sump wall. Area 22 of FIG. 1 generally illustrates a volume comprising the region of the sump where the monitor is sensitive to development material. The monitor would, of course, be sensitive to material between area 22 and shielding cup 16 except that this region comprises the protective covering 18 and possibly the station wall 20.

Referring to FIG. 2, current toning station technology has largely eliminated the classical sump. Newer stations feature sump walls with curved inner surfaces which closely follow the radius of an internal paddle-wheel, ribbon blender, or similarly-shaped longitudinal mixer/blender. The outer surface of the sump wall may be flat, as shown in FIG. 2, or curved as shown in commonly assigned U.S. Pat. No.4,775,915, which issued to George R. Walgrove on Oct. 4, 1988.

If the radius of such a curved sump inner wall surface is large, then flat-faced traditional monitors can be used without severe problems. In more severe situations of shorter-radius inner wall configurations, a substantially larger portion of the sensitive volume 22 is occupied by the sump wall, as indicated in FIG. 2 by the area above the dotted lines; leaving less of the development mixture in the sensitive volume. This decreases the sensitivity of the toner monitor.

DISCLOSURE OF INVENTION

It is an object of the present invention to provide a toner monitor with enhanced sensitivity when used to measure the concentration of development mixture in a development station having sump walls with a curved inner surface.

According to one feature of the present invention, the open-end of the solenoid and/or its shielding cup are conformed to the radius of the surface of the development station sump's inner wall surface. In this configuration the magnetic field is contained until a point just behind the protective covering of the shield and solenoid assembly, extending the volume within the toning station to which the monitor is sensitive.

In a preferred embodiment of the present invention, a monitor for sensing the concentration of toner particles in the development station of an electrostatographic machine, having a sump wall with a curved inner surface, includes a solenoid having a coil-form with one end adapted to be positioned adjacent to the outer surface of the sump wall, and a shield at least partially surrounding the solenoid and having an end adjacent to the wall, wherein the surfaces of the ends of the coil-form and the shield define a substantially cylindrical surface which conforms to the shape of the inner surface of the sump wall. Preferably, the surfaces of the ends of the coil-form and the shield are adapted to be substantially equal distant from the sump wall's inner surface.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

BEST MODE FOR CARRYING OUT THE INVENTION

Figure 1:
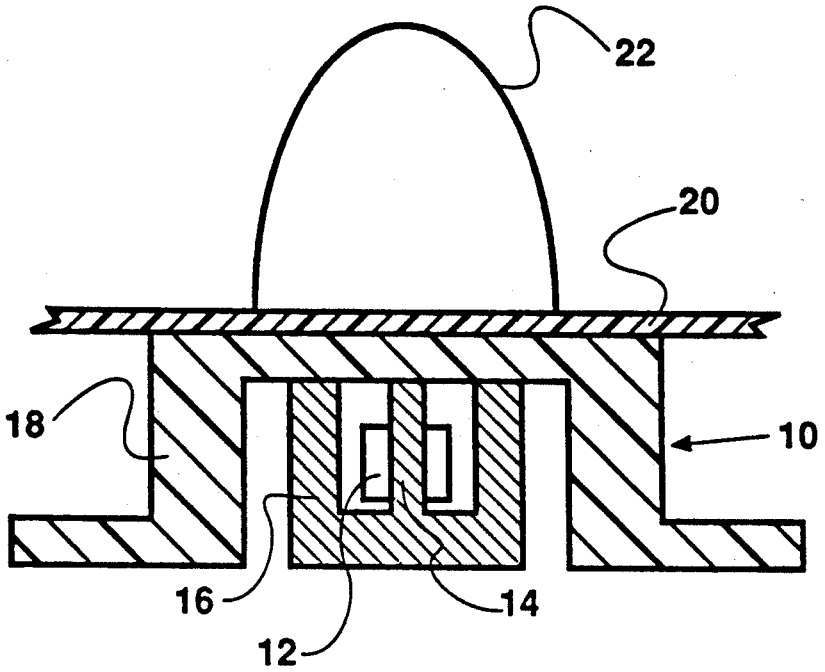
FIG. 1 (PRIOR ART)
FIG. 1 is a schematic sectional view of a toner monitor and development station according to the prior art.
Figure 2:
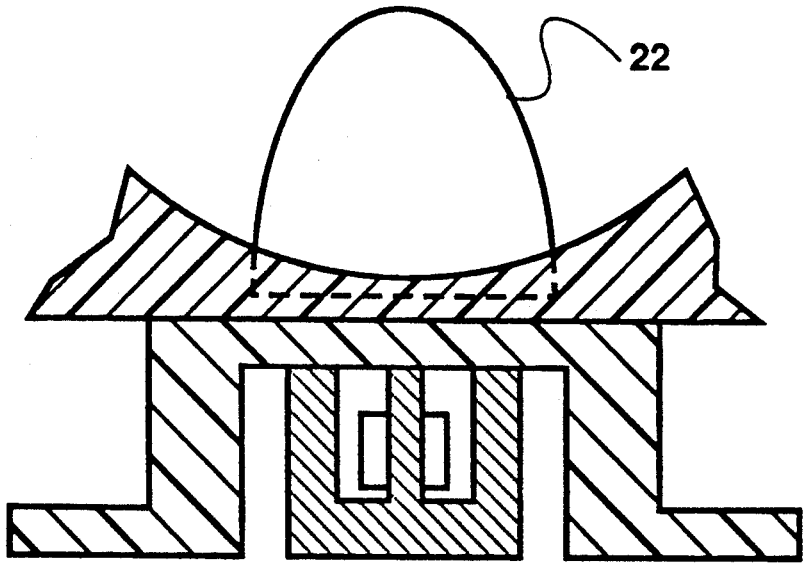
FIG. 2 (PRIOR ART)
FIG. 2 is a schematic sectional view of the toner monitor of FIG. 1 and another development station configuration according to the prior art.
Figure 3:
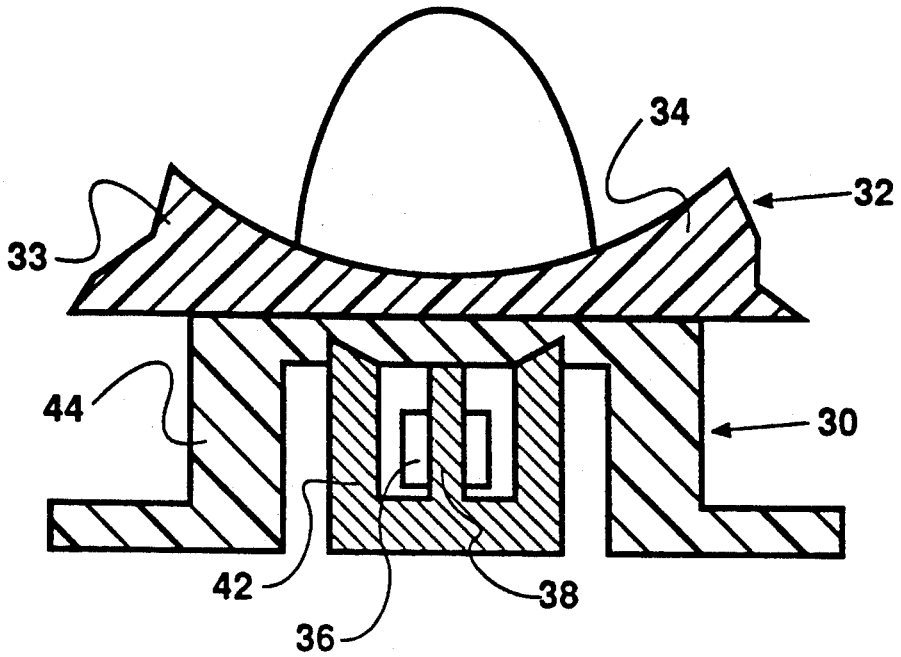
FIG. 3 is a schematic sectional view of a toner monitor according to the present invention and a development station of FIG. 2.

Referring to FIG. 3, a toner monitor 30 according to a preferred embodiment of the present invention is shown positioned adjacent to a development station 32. The development station includes a development mixture sump with a wall 33 having a curved inner surface 34, which closely follows the radius of an internal paddle-wheel, ribbon blender, or similarly-shaped longitudinal mixer/blender, not shown.

Toner monitor 30 includes an unshielded solenoid coil 36 wound on a coil-form 38 containing a small slug (not shown) of permeable material which can be moved toward and away from the open end of the solenoid to adjust the solenoid inductance. A shielding cup 42 of permeable material, such as for example pressed and baked ferrite powder, confines the magnetic field path, thereby reducing the effect on the solenoid's inductance of material behind and beside the solenoid. The monitor is enclosed in a plastic protective covering 44, the face of which abuts the outer surface of development station sump wall 33. Toner monitor 30 produces a signal characteristic of changes in the inductance of the solenoid due to the presence of magnetic material within the fringe field of the solenoid.

At the open of shielded toner monitor 30, the ends of solenoid coil-form 38 and surrounding shielding cup 42 define a cylindrical surface which generally conforms to the inner surface of the wall of the development station sump. By extending the shielding cup toward the interior of the development station sump, the sensitivity of the monitor to toner concentration and the signal-to-noise ratio are improved over that of existing, planar monitors.

Figure 4:
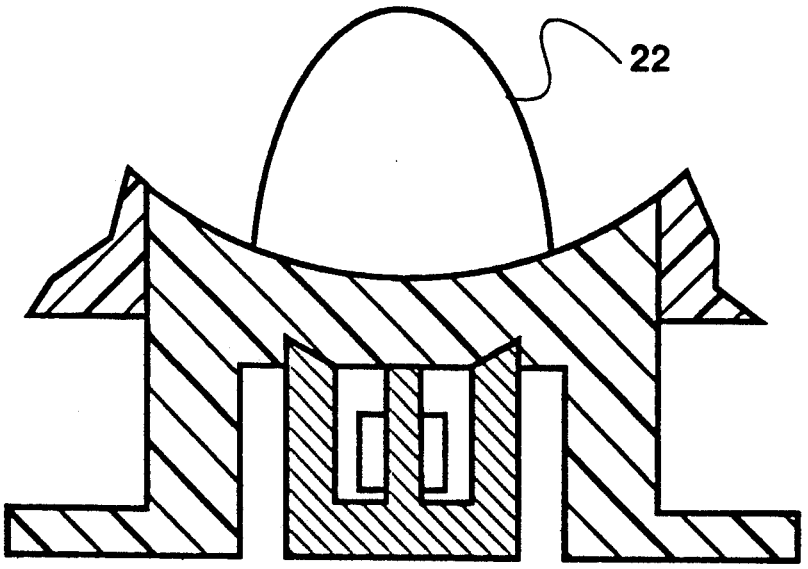
FIG. 4 is a schematic sectional view of a toner monitor according to another embodiment of the present invention and a development station of FIG. 2.

FIG. 4 shows a second embodiment of the present invention wherein the toner monitor extends through a hole in the development station wall.

The invention has been described in detail with particular reference to preferred embodiments thereof, but it will be understood that variations and modifications can be effected within the spirit and scope of the invention.

What is claimed is:

1. A monitor for sensing a concentration of toner particles in a development station of an electrostatographic machine having a development mixture sump wall with a curved, generally cylindrically shaped, inner wall surface; said monitor comprising:

a solenoid having a central coil-form with one end adapted to be positioned adjacent to the sump wall; and a shield, made of a permeable material, at least partially surrounding the solenoid and having an end adjacent to the curved inner wall surface, wherein the surface of the end of the central coil-form and the surface of the end of the shield define a substantially cylindrical surface which conforms in shape to the curved inner wall surface of the sump wall.

2. A monitor as set forth in claim 1 wherein the central coil-form and the shield are encased in a protective covering which abuts an outer surface of the sump wall.

3. A monitor as set forth in claim 1 wherein the central coil-form and the shield are encased in a protective covering which protrudes through an opening in the sump wall.

4. A monitor for sensing a concentration of toner particles in a development station of an electrostatographic machine having a development mixture sump wall with a curved, generally cylindrically shaped, inner wall surface; said monitor comprising:

a solenoid having a central coil-form with one end adapted to be positioned adjacent to the sump wall; and a shield, made of a permeable material, at least partially surrounding the solenoid and having an end adjacent to the curved inner wall surface, wherein the surface of the end of the central coil-form is adapted to be substantially equal distant from an outer wall of a received toner housing.

* * * * *